US007661567B2

(12) United States Patent
Myers

(10) Patent No.: US 7,661,567 B2
(45) Date of Patent: Feb. 16, 2010

(54) STICK-ON SECURITY RING FOR A HAND HELD DEVICE

(75) Inventor: Gregory B. Myers, Marina Del Ray, CA (US)

(73) Assignee: RND Development, Reno, NV (US)

( * ) Notice: Subject to any disclaimer, the term of this patent is extended or adjusted under 35 U.S.C. 154(b) by 196 days.

(21) Appl. No.: 11/543,331

(22) Filed: Oct. 5, 2006

(65) Prior Publication Data

US 2008/0083797 A1 Apr. 10, 2008

(51) Int. Cl.
*B65H 75/40* (2006.01)
*A61C 19/00* (2006.01)

(52) U.S. Cl. ..... 224/217; 224/162; 224/930

(58) Field of Classification Search ..... 24/3.13, 24/298, 17 B, 300, 482, 1, 713.3, 713.4, 714.6, 24/115 N; 248/690, 683; 224/217, 162, 224/930, 255

See application file for complete search history.

(56) References Cited

U.S. PATENT DOCUMENTS

| | | | | |
|---|---|---|---|---|
| 471,854 | A | 3/1892 | Gareis | |
| 574,720 | A | 1/1897 | Ekengren | |
| 1,290,433 | A * | 1/1919 | Walker | 248/690 |
| 2,292,563 | A | 8/1942 | Imhoff | |
| 2,554,629 | A * | 5/1951 | Meyer | 63/3 |
| 2,635,604 | A * | 4/1953 | Fredrickson | 604/403 |
| 4,611,368 | A * | 9/1986 | Battersby | 24/116 R |
| 5,520,031 | A * | 5/1996 | Davidge | 70/18 |
| 5,699,591 | A * | 12/1997 | Kane | 24/304 |
| 5,938,137 | A | 8/1999 | Poulson | |
| 6,314,184 | B1 | 11/2001 | Fernandez-Martinez | |
| 6,427,293 | B1 * | 8/2002 | Bowes, Jr. | 24/304 |
| 6,434,797 | B1 * | 8/2002 | Sagman | 24/3.13 |
| 6,502,727 | B1 | 1/2003 | Decoteau | |
| 6,550,108 | B2 * | 4/2003 | Pratl | 24/3.13 |
| 6,575,649 | B1 * | 6/2003 | Kuan-Hsiung et al. | 401/131 |
| 6,591,461 | B2 | 7/2003 | Salentine et al. | |
| 6,662,986 | B2 | 12/2003 | Lehtonen | |
| 6,735,825 | B1 * | 5/2004 | Berman et al. | 24/3.13 |
| 6,966,519 | B2 | 11/2005 | Salentine et al. | |
| 6,985,110 | B2 | 1/2006 | Tanaka et al. | |
| 7,010,331 | B2 | 3/2006 | Johnson et al. | |
| 7,354,304 | B2 * | 4/2008 | Livingston | 439/501 |

FOREIGN PATENT DOCUMENTS

| | | |
|---|---|---|
| WO | WO 2005/115101 | 12/2005 |

* cited by examiner

*Primary Examiner*—Nathan J Newhouse
*Assistant Examiner*—Corey N Skurdal
(74) *Attorney, Agent, or Firm*—Gene Scott; Patent Law & Venture Group

(57) ABSTRACT

A button provides an adhesive flat bottom surface for attachment to a cell phone or similar hand held device. A leash extends from the button and terminates with a finger ring. When the device is held in a hand with one finger secured in the ring, the device is secured in the hand so that it is less likely to fall. The ring may be an extension of the leash, both a part of an elastic cord loop where the leash is secured within the button and the ring extends away from the button. The leash may be retractable.

3 Claims, 4 Drawing Sheets

STICK-ON SECURITY RING FOR A HAND HELD DEVICE

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to security belts, rings and related articles for restraining a device from moving, falling or otherwise being damaged, and more particularly to a small adhesive button having a loop for receiving a finger so that a hand-held device is manually secured more effectively over mere hand gripping pressure.

2. Description of Related Art Including Information Disclosed Under 37 CFR 1.97 and 1.98

J. G. Gareis, U.S. Pat. No. 471,854 discloses a pocket-book support, which is simple and durable in construction and designed to conveniently attach the pocket-book to the hand of the owner to prevent it from being snatched or misplaced in stores and other places and at the same time permitting a convenient opening and closing of the book when ever desired. The improved pocket-book support is provided with a ring, made of leather or metal or other suitable material, the ring being connected by a swivel with the back of the pocket-book. The ring is engaged by a finger of the wear's hand, so that the pocket-book is supported in the hand.

J. Ekengren, U.S. Pat. No. 574,720 discloses a means for holding the pocket-book or purse securely when carried in the hand, and in such a manner as to permit its being opened without detaching it from the finger to which it is secured. The securing device is composed of a bar or shank that runs through the pocket-book and an addition portion of the bar runs along the outer portion of the pocket-book. Midway along the pocket-book, the outer portion of the bar is shaped to form a ring conveniently sized to receive one or more fingers. In carrying the pocket-book a finger or fingers can be inserted through the ring while the pocket-book is held in the hand so as to prevent it from being snatched.

C. A. Imhoff, U.S. Pat. No. 2,292,563 discloses a finger ring hook for attaching a key for securing a key in ones hand. The user merely slips the ring portion on the finger with the result that the keys are comfortably positioned in the palm of the hand, held against loss or misplacement and are ready for instant use, the key retainer presenting the appearance of being a finger ring.

Fernandez-Martinez, U.S. Pat. No. 6,314,184 discloses a mobile telephone apparatus/wireless telephone terminal mounted in a fixed or removable way to a bracelet support having a portion wherein are housed electric supply batteries for supplying power to the device. The telephone apparatus has a front panel with keyboard, a presentation display, and a microphone, the apparatus having preferably its larger dimension (T) oriented obliquely with respect to the longitudinal direction (P) of the bracelet. A ring-shape part intended to be coupled to one finger of the user hand is removable with respect to the apparatus and supports an earphone for the said apparatus to which it is connected by an extensible electric cable or by radio.

Tanaka et al., U.S. Pat. No. 6,985,110 discloses an antenna device, a radio communication terminal, an external antenna, and a hand strap can be provided, which are capable of ensuring satisfactory communication performance without being affected by the surrounding environment even in an area where the electric field is weak, and having the antenna performance improved by slightly modifying the body of an existing radio communication device. The antenna device according to the present invention includes an internal antenna electrically connected to and incorporated into a circuit for radio communication within a case and an external antenna externally attached to the case.

Johnson et al., U.S. Pat. No. 7,010,331 discloses a mobile telephone handset construction, which is adapted to be attached removably in an inverted manner to a support element, such as a strap, loop or ring attached to a back-pack or other article of wearing apparel, or any other suitable support element used for supporting the handset construction. The construction of an embodiment of the invention can be quickly retrieved and responded to in a convenient manner when a call is being received. The construction includes a display mounted at a top front face portion of a housing to present information to the user when the display is viewed in a position adapted to be read by the user. A carabiner latch is connected to the housing for attaching to the support element to suspend the construction therefrom in an inverted manner for storage purposes. The latch is secured to a bottom portion of the housing at a substantial distance from the display to enable the handset construction to be suspended in an inverted substantially vertical position from the support element and able to be moved pivotally from the inverted position by the hand of the user in a quick and convenient manner to a position where the user is permitted to read the information contained on the display. All of this can be accomplished while the construction remains attached to the support element.

Poulson, U.S. Pat. No. 5,938,137 discloses a leash attached to a cell phone case including a spring retractable leash cord in a housing pivotally attached to the belt will prevent dropping and damage to a cell phone in a case clipped to the belt. The leash housing is pivotally attached to a locking belt hook that cannot easily be accidentally removed.

Decoteau, U.S. Pat. No. 6,502,727 discloses a device and associated method for attaching an electronic device to a tether so that it cannot be stolen or inadvertently lost. The device includes a housing. Within the housing is contained a spool and a spring for rewinding the spool. A tether extends from the spool out of the housing. The tether terminates outside of the housing with a connector element. The connector element is selectively attachable to an electronic device. As the tether is wound on the spool, the connector element is drawn toward an attachment area on the housing of the device. The connector element and the attachment area are magnetically attracted. As such, when the connector element approaches the attachment area on the housing, the connector element becomes magnetically affixed to the attachment area, thereby joining the electronic device to the housing in a fixed orientation.

Salentine et al., U.S. Pat. No. 6,966,519 discloses a retracting tether apparatus is disclosed comprising a retractor housing having a locking post on its outside surface. The apparatus also includes an attachment mechanism, such as a belt clip, for attaching to a body and a retaining section, the attachment mechanism being integral to the retaining section. The retaining section has a retaining section hole sized to mate with the locking post and the locking post has a mechanism for holding the post in the retaining section hole. The inside surface of the retaining section hole rides on an outside surface of the locking post to provide for smooth rotation of the retractor housing in relation to the retaining section.

Salentine et al., U.S. Pat. No. 6,591,461 discloses a connector to attach cable or line to an article of gear whereby the cable or line is protected from fatigue through the use of a strain relief system and incorporates the ability to easily connect or disconnect the gear from the cable. The cable/line is permanently attached to the cable connection device with a knot or cable crimp. A strain relief for the cable/line is provided by a spring wrapped around the cable/line to prevent bending at the connection point, a heavy material coating around the cable/line again to prevent bending at the connection point, or a pivoting ball connection to allow the cable/line to move without bending the cable/line at the joint. A disconnect method is provided by a clipping system that allows the cable connection device to be connected or disconnected from the gear.

Lehtonen, U.S. Pat. No. 6,662,986 discloses a mobile phone and strap apparatus for carrying a mobile phone. A mobile phone is provided with openings in the corners of the mobile phone housing through which a flexible line is passed and cooperates with a strap and latch that secures ends of the flexible line. The strap, latch and flexible line are adapted to secure an object between the mobile phone housing, the flexible line and strap when ends of the flexible line are drawn through the latch.

Michael Horton, WO 2005/115101 discloses a clip configuration including a contoured case forming a support opening for a moveable clasp element defining a universal clip.

The related art described above discloses straps, retractable cords and rings arranged for securing devices. However, the prior art fails to disclose an adhesive button having a ring that is secured to the button but which can be placed into a position for gripping a finger of a hand that is holding a device in a secure manner. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Cell phones, electronic game units and a variety of other devices are hand-held and subject to being damaged by dropping. The subject apparatus is a button that provides an adhesive flat bottom surface for attachment to valuable hand-held devices. A leash extends from the button and terminates with a finger ring. When the device is held in a hand with one finger secured in the ring, the device is secured in the hand so that it is less likely to fall. The ring may be an extension of the leash, both a part of an elastic cord loop where the leash is secured within the button and the ring extends away from the button. The leash may be retractable.

A primary objective inherent in the above described apparatus and method of use is to provide advantages not taught by the prior art.

Another objective is to provide a small adhesive device that is easily mounted onto a cell phone or other hand-held device and capable of engaging a finger of the hand holding the device so as to improve securement.

A further objective is to provide such a device that has a retractable cord terminating with a finger ring.

A further objective is to provide such a device wherein the ring snaps into a recess in the button.

A further objective is to provide such a device wherein the ring is able to be captured around the peripheral edge of the button.

A further objective is to provide such a device wherein the ring is formed from an elastic loop.

A further objective is to provide such a device wherein a portion of the loop is engaged within the button and a further portion is external to the button for gripping a finger.

A further objective is to provide such a device wherein the external portion may be extended from the button in a selected direction.

A further objective is to provide such a device wherein the button and the ring are made from a common disk of elastic material.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s) perspective views of the present invention are shown illustrating:

Figure 7:
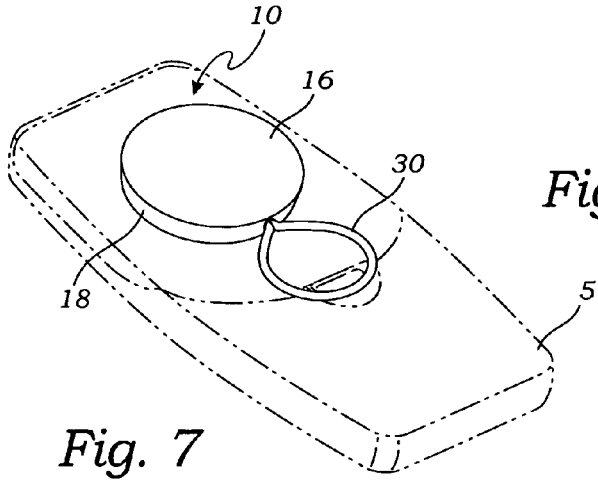
Figure 9:
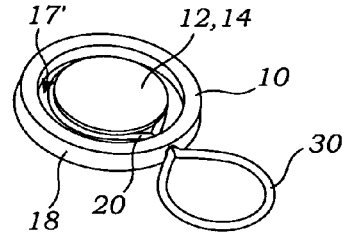
Figure 8:
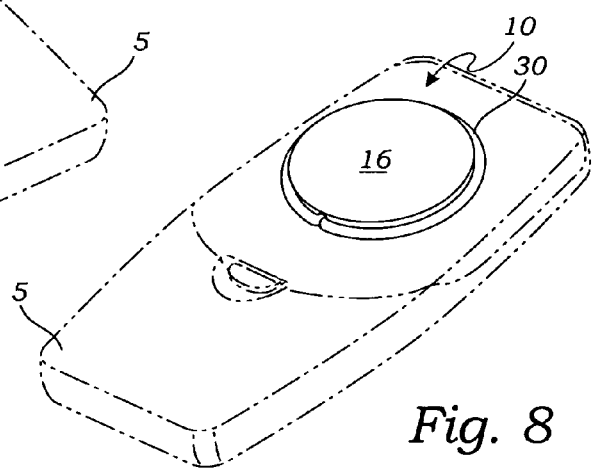
Figure 10:
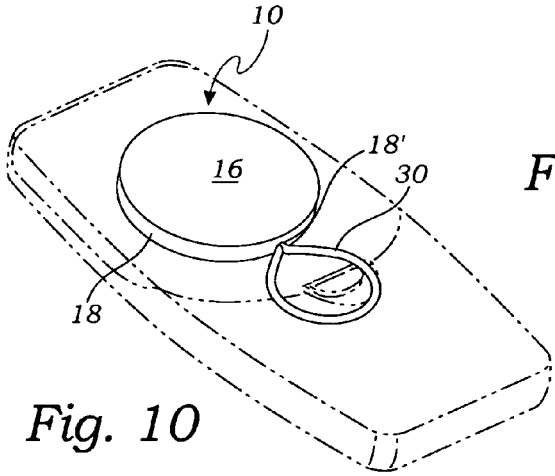
Figure 11:
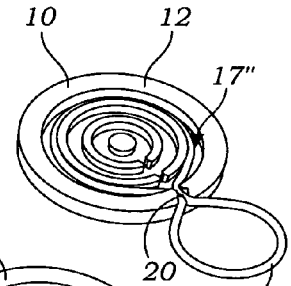
Figure 12:
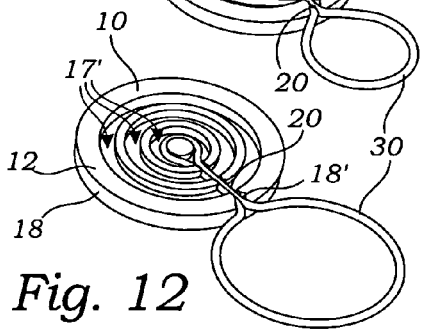
Figure 13:
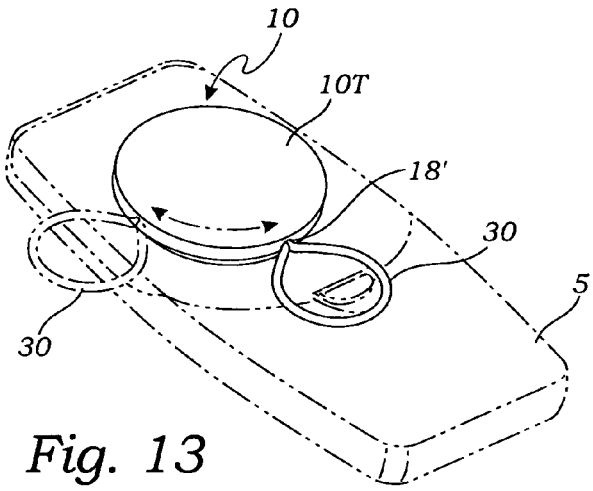
Figure 14:
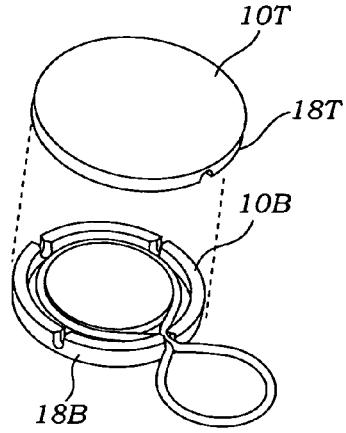

FIGS. 7, 8, and 9 show a fourth embodiment and its method of use;

FIGS. 10-12 show a fifth embodiment and its method of use, wherein FIG. 10 is a top perspective view, while FIGS. 11 and 12 are bottom perspective views;

FIGS. 13 and 14 show a sixth embodiment and its method of use; and

Figure 15:
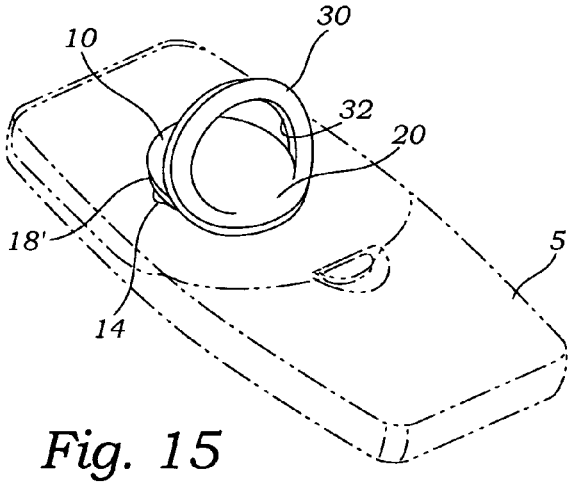
Figure 16:
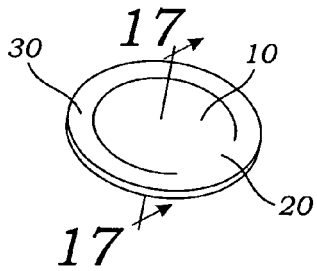
Figure 17:
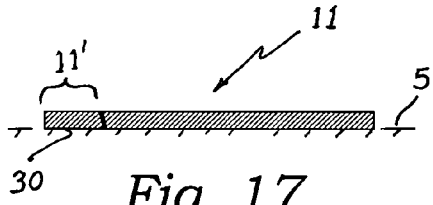

FIGS. 15-17 show a seventh embodiment and its method of use.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is a security device for a hand-held apparatus 5 such as a cell phone, PDA, Game Boy and the like. The device includes a 10 button having a flat bottom surface 12 (FIG. 9) with an adhesive material 14 on it for sticking the button 10 to a surface 7 of the apparatus 5. A top surface 16 (FIG. 7) of the button 10 is spaced apart from the bottom surface 12 and the button 10 provides a peripheral edge 18 joining and contiguous with the bottom surface 10 and the top surface 16. This structure is clearly illustrated in FIG. 1 and the other figures of the enclosed drawings. A flexible leash 20 has a proximal end 22 and a distal end 24, (FIG. 6) wherein the proximal end 22 engages the button 10 in one of several possible ways, and the distal end 24 engages a ring 30 in several possible ways, as described in detail below. The leash 20 need not be necessarily a long slender cord or line, but may be a short or very short segment of material. The ring 30, may not be a circular object, nor even a continuous object, but may be of various configurations with the common attribute that the ring 30 is able to be placed around a human finger. The ring 30 is sized for accepting a finger, or is elastic for expanding to accept a finger, and as discussed, is engaged with the distal end 24 of the leash 20. These three components, the button 10, leash 20 and ring 30 make up the present invention. Described below are several ways of combining these three components to achieve the stated advantages of the invention, however, all of the embodiments share the three components in common and all provide certain common advantages as well, as will be described in further detail below.

Figure 1:
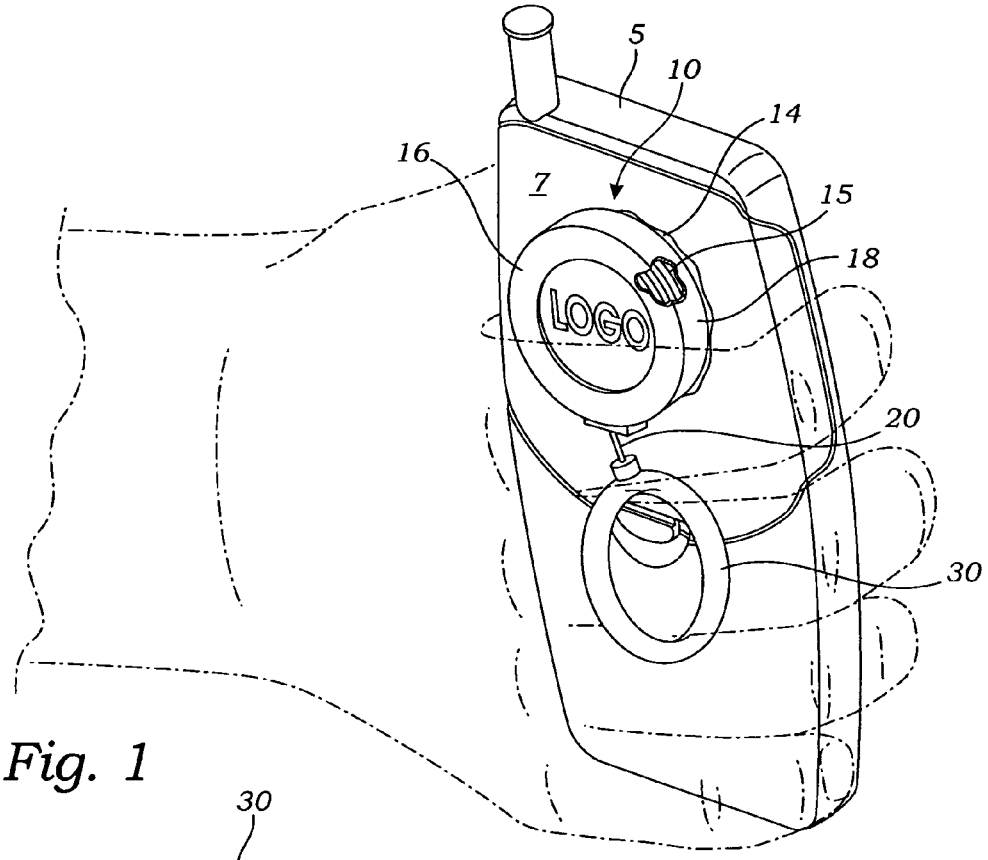
FIGS. 1 and 2 show a first embodiment and its method of use.
Figure 2:
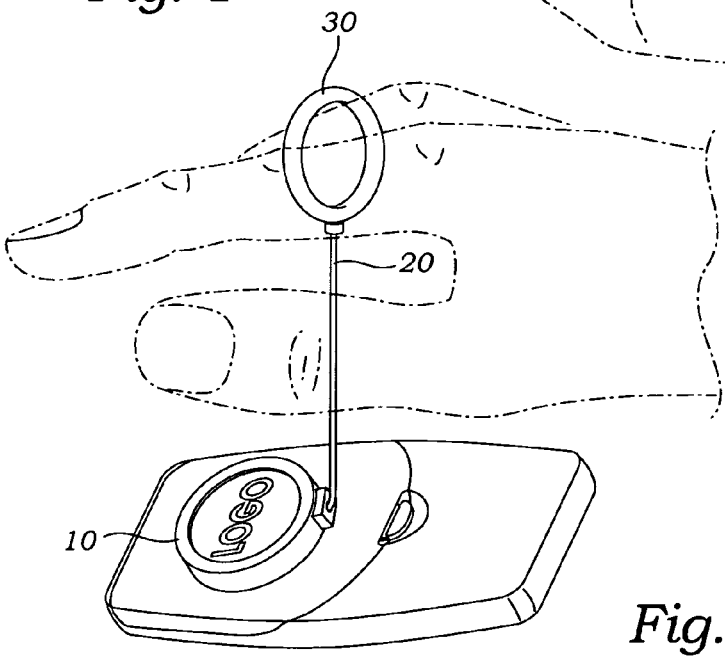

As shown in the embodiment of FIGS. 1 and 2, the button 10 incorporates a retractable reel 15, preferably housed within the button 10 as shown, the reel 15 engaging the proximal end 22 of the leash 20, with the leash 20 thereby enabled for play-out from, and retraction into the button 10. A retractor device is shown and described in U.S. Pat. No.

6,591,461 which is hereby incorporated by reference herein.

Figure 3:
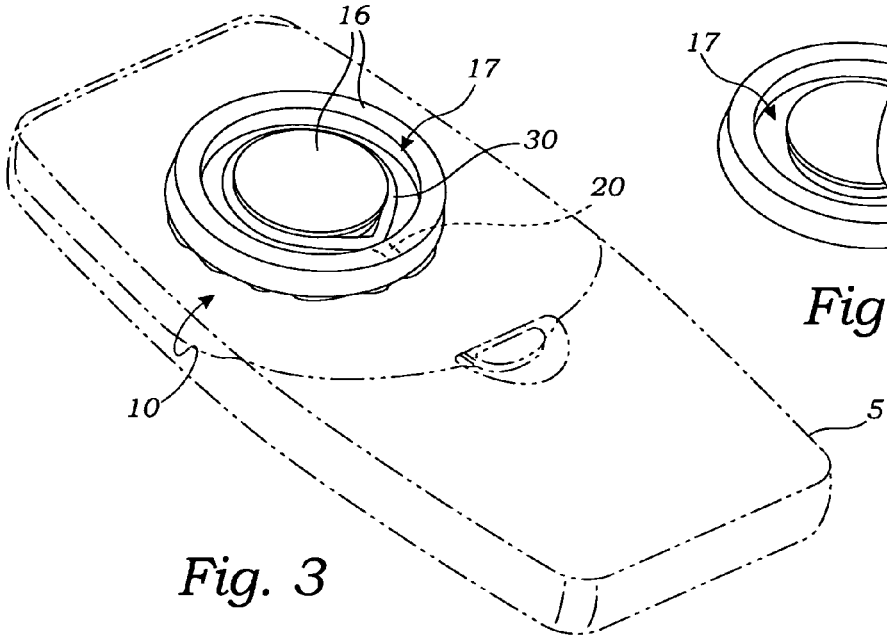
FIGS. 3 and 4 show a second embodiment and its method of use.
Figure 4:
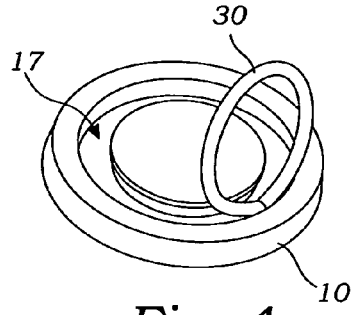

In the embodiment shown in FIGS. 3 and 4, the top surface 16 provides a top recess 17 sized for receiving the ring 30. The ring 30 in this case can be an elastic cord attached at one end to the top surface 16 or within the recess, as shown and movable between a storage attitude nested within the recess 17, shown in FIG. 3, and an upstanding attitude for receiving a finger, as shown in FIG. 4.

Figure 5:
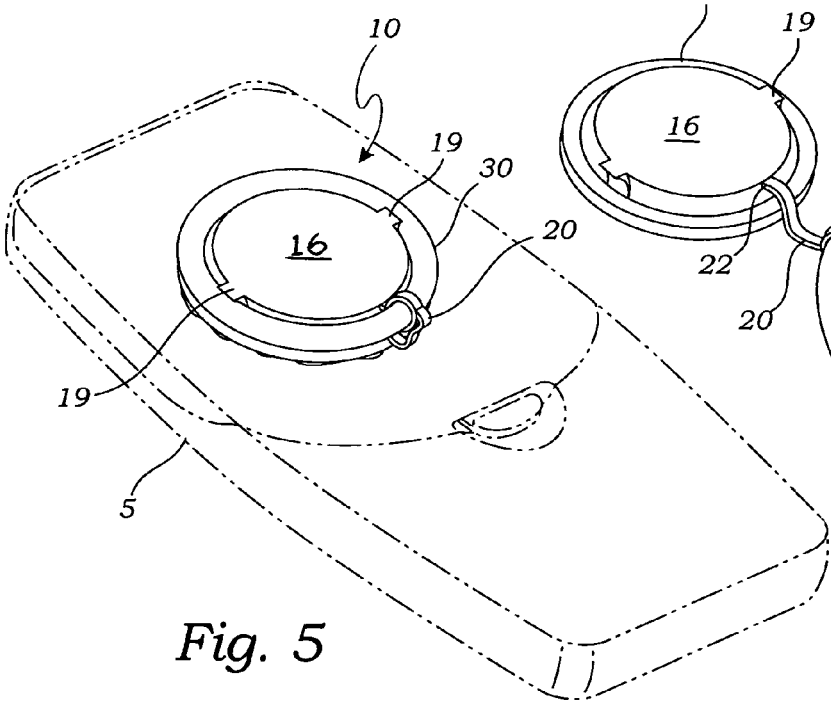
FIGS. 5 and 6 show a third embodiment and its method of use.
Figure 6:
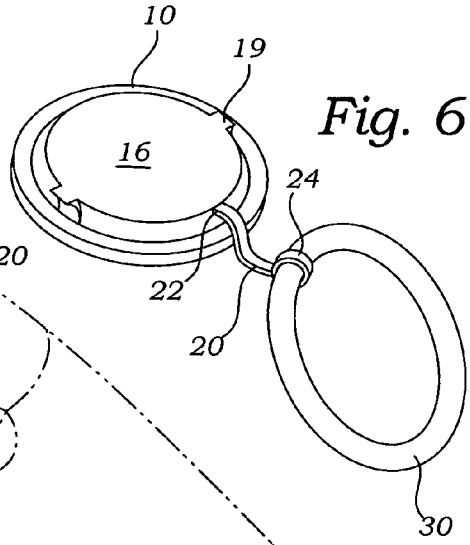

In the embodiment shown in FIGS. 5 and 6, the button 10 provides at least two opposing fingers 19 protruding outwardly from the button 10, as shown. The fingers 19 are sized and positioned so as to enable snap-action placement of the ring 30 around the button 10, the ring thereby being physically secured on the button 10 by the fingers 19. In this manner, the ring 30 is secured in the storage attitude until needed whereupon it may be snapped off of the button, as shown in FIG. 6, and secured around a finger to accomplish its mission of holding the device 5. In this embodiment, the ring 30 may be rigid or semi-rigid to enable the snap-action, i.e., the dimensions of the ring 30 and the fingers 19, and their material flexibility such that the ring can be placed as shown in FIG. 5 by elastic deformation of ring 30 and-or fingers 19. The ring 30 is removed, again, by snap-action as described.

In the embodiments shown in FIGS. 7-14, the leash 20 is preferably a first part of an elastic cord formed as a loop. The ring 30 is a second part of this elastic cord and is contiguous with the first part 20. In FIG. 9 the first part (leash 20) is engaged within a bottom recess 17' in the button 10. The recess 17' is sized for receiving the leash 20 therein, while the second part (ring 30) extends radially outwardly from the button 10.

FIG. 9 is preferably a bottom view of the button 10, with FIGS. 7 and 8 both being top views. Preferably, the peripheral edge 18' provides a contour shape so as to capture the second part, ring 30, when the second part is stretched around the peripheral edge as shown in FIG. 8. Such a contour may be convergent downward, as shown in FIG. 7, or concave, etc. With such an edge 18, once the ring 30 has been stretch about the edge 18, it is held in place by the tension in the material due to stretching of ring 30.

In an elaboration of the approach shown in FIGS. 7-9, FIGS. 10-12, show that an advantage may be obtained by providing more than one concentric recess 17' formed in the bottom surface 12 of the button 10 and these recesses 17' are joined by a groove 17". Each of the recesses is sized for receiving the first part, leash 20 and because these recesses are of different circumference, one may decide on how much of the entire elastic loop is taken-up by the button 10 and how much is then left to form ring 30. This enables one to obtain a ring 30 of proper size depending on the finger size that is to be engaged with the ring 30. For instance, in FIG. 11 the elastic loop is coiled about the largest recess 17' leaving relatively little material for ring 30. The opposite effect is achieved as shown in FIG. 12. It is pointed out that the second part, ring 30 joins first part, leash 20 through an opening 18' in edge 18.

In a still further embodiment, shown in FIGS. 13 and 14, the button 10 comprises a top portion 10T and a bottom portion 10B. Also, the peripheral edge 18 comprises a top peripheral edge portion 18T integral with the top portion 10T, and a bottom peripheral edge portion 18B integral with the bottom portion 10B. Either one of the top and bottom peripheral edge portions 10T, 10B, provides one or more openings 18' (see 18T in FIG. 14), and the other one of the peripheral edge portions provides plural openings 18' (see 18B in FIG. 14), where each one of the plural openings 18' is alignable with the at least one opening 18' when the top portion 10T of the button 10 is engaged with the bottom portion 10B of the button 10. In this case, the elastic cord forms a continuous loop, where the first part of the loop, the leash 20 is enclosed within the button 10, and the second contiguous part of the loop, the ring 30, extends through the openings 18' to form the ring 30 external to the button 10. It should be seen, from FIG. 13, that depending on the clock position of top portion 10T, the ring 30 may be selectively positioned for convenience with respect to how the user holds his or her device 5. Clearly, the attributes and benefits of the embodiment of FIGS. 10-12 may be combined with those of FIGS. 13 and 14.

In a still further embodiment, shown in FIGS. 15, 16 and 17, the button 10, leash 20, and ring 30 may be formed from an integral elastomeric disc 11 such as one of silicone rubber or the like. The ring 30 is cut from an outer annular portion 11' of the disc 11, leaving the button 10 remaining centrally. A common uncut portion of the annular portion 11' of the disc 11' servers as the leash 20 as best shown in FIG. 15. As stated previously, the term "leash" as used herein is defined as a portion of flexible material that joins the button 10 and the ring 30, and in this embodiment this definition is fully met.

Preferably, the interior surface of the ring 32, and an exterior surface of the button 18' are configured to mutually nest, the configuration of these surfaces being of such shape as to resist moving the ring 30 out of planar congruency with the button 30. This is accomplished by cutting the ring from the disk 11' on a slant, shown in FIG. 17.

Preferably, in all of the above described embodiments and obvious extension thereof, the top surface 16 of the button 10 has a large coefficient of friction so that when the device 5 is placed onto a surface the device is inhibited from sliding.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus comprising:

a disk-shaped object having two opposing outer surfaces joined by a peripheral surface;

a circular groove, and a radial groove within the disk-shaped object, the radial groove intersecting the circular groove, the circular groove concentric with at least one further circular groove, the at least one further circular groove intersecting the radial groove;

an aperture joining the peripheral surface with the circular groove and the radial groove, wherein the radial groove and the aperture are collinearly aligned; and a cord shaped as an endless loop, the cord engaging the circular groove and the aperture and extending therefrom exteriorly away from the peripheral surface.

2. The apparatus of claim 1 wherein said circular groove is concentric with at least two further circular grooves, the at least two further circular grooves each intersecting the radial groove.

3. The apparatus of claim 1 wherein the cord is made of an elastic material.

* * * * *